US011692766B2

(12) United States Patent
Park et al.

(10) Patent No.: US 11,692,766 B2
(45) Date of Patent: Jul. 4, 2023

(54) REFRIGERATOR

(71) Applicant: LG ELECTRONICS INC., Seoul (KR)

(72) Inventors: Ahreum Park, Seoul (KR); Younseok Lee, Seoul (KR); Junsoo Han, Seoul (KR); Yongjin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 392 days.

(21) Appl. No.: 16/572,932

(22) Filed: Sep. 17, 2019

(65) Prior Publication Data

US 2020/0011594 A1 Jan. 9, 2020

Related U.S. Application Data

(63) Continuation of application No. 15/097,615, filed on Apr. 13, 2016, now Pat. No. 10,458,699.

(30) Foreign Application Priority Data

Jun. 5, 2015 (KR) ..... 10-2015-0080105

(51) Int. Cl.
*F25D 25/02* (2006.01)
*F25D 17/06* (2006.01)

(52) U.S. Cl.
CPC ..... *F25D 25/025* (2013.01); *F25D 17/06* (2013.01); *F25D 2317/061* (2013.01)

(58) Field of Classification Search
CPC ..... F25D 17/06; F25D 17/062; F25D 25/025; F25D 2317/061; F25D 2317/0667; F25D 2317/067

(Continued)

(56) References Cited

U.S. PATENT DOCUMENTS 9,010,145 B2 * 4/2015 Lim ..... F25D 11/022 62/417
2003/0115892 A1 * 6/2003 Fu ..... F25D 25/021 62/187

(Continued)

FOREIGN PATENT DOCUMENTS

CN 101487653 7/2009
CN 101776362 A * 7/2010 ..... F23D 14/02

(Continued)

OTHER PUBLICATIONS

Chinese Office Action dated Nov. 3, 2020 issued in CN Application No. 201910661330.8.

(Continued)

*Primary Examiner* — Elizabeth J Martin
(74) *Attorney, Agent, or Firm* — Ked & Associates LLP

(57) ABSTRACT

A refrigerator may include a cabinet forming a storage compartment; a rear panel forming a rear wall of the storage compartment and having a cooling air outlet hole which discharges cooling air toward the storage compartment; a fan housing coupled to the rear panel and in which a fan configured to circulate cooling air is installed; an outlet port which is formed at the fan housing and discharges cooling air supplied by driving of the fan; and a drawer provided capable of being withdrawn forward from an inside of the storage compartment, wherein the drawer includes: a drawer body forming a storage space; and a cooling air duct provided above the drawer body and having a cooling air path in communication with the outlet port.

18 Claims, 15 Drawing Sheets

(58) Field of Classification Search
USPC ..... 62/417
See application file for complete search history.

(56) References Cited

U.S. PATENT DOCUMENTS

| | | | | |
|---|---|---|---|---|
| 2005/0140257 | A1 | 6/2005 | O'Halloran | |
| 2008/0134712 | A1 | 6/2008 | Civanelli | |
| 2008/0168792 | A1* | 7/2008 | Tunzi | F25D 17/065 62/407 |
| 2008/0196440 | A1 | 8/2008 | Kang | |
| 2010/0154460 | A1* | 6/2010 | Kim | F25D 17/065 62/449 |
| 2011/0023530 | A1 | 2/2011 | An et al. | |
| 2011/0259036 | A1* | 10/2011 | Lim | F25C 1/24 62/344 |
| 2013/0000333 | A1* | 1/2013 | Kim | F25D 25/025 62/129 |
| 2014/0265802 | A1* | 9/2014 | Wilcox | F25D 25/025 312/404 |
| 2014/0290302 | A1 | 10/2014 | Shin et al. | |

FOREIGN PATENT DOCUMENTS

| | | | | |
|---|---|---|---|---|
| CN | 101846427 | | 9/2010 | |
| CN | 102901317 | | 1/2013 | |
| CN | 104101155 | | 10/2014 | |
| CN | 104344635 | | 2/2015 | |
| CN | 104350343 | | 2/2015 | |
| CN | 104501519 | | 4/2015 | |
| CN | 106016936 | | 10/2016 | |
| EP | 2 861922 | | 4/2015 | |
| EP | 3 072 418 | | 9/2016 | |
| KR | 10-2006-0128421 | | 12/2006 | |
| KR | 10-2007-0065710 | | 6/2007 | |
| KR | 10-2007-0093494 | | 9/2007 | |
| KR | 10-2008-0079062 | | 8/2008 | |
| KR | 10-2011-0006997 | | 1/2011 | |
| KR | 10-2012-0019630 | | 3/2012 | |
| KR | 10-2011-0109348 | A | 5/2013 | |
| KR | 20130044959 | A * | 5/2013 | F25D 23/069 |
| KR | 10-2013-0060462 | | 6/2013 | |
| WO | WO 2013/186128 | | 12/2013 | |

OTHER PUBLICATIONS

Korean Office Action dated Oct. 20, 2016 issued in Application No. 10-2015-0080105.

European Search Report dated Nov. 2, 2016 issued in Application No. 16165768.9.

European Search Report dated Feb. 7, 2017 issued in Application No. 16 16 5768.9.

Korean Office Action dated Mar. 10, 2017 issued in Application No. 10-2015-0080105.

Chinese Office Action dated Jun. 26, 2018 with English Translation.

European Notice of Allowance dated Nov. 23, 2018 issued in EP Application No. 16 165 768.9.

* cited by examiner

REFRIGERATOR

CROSS-REFERENCE TO RELATED APPLICATIONS

This application is a Continuation of U.S. application Ser. No. 15/097,615, filed Apr. 13, 2016, which claims priority under 35 U.S.C. § 119 and 35 U.S.C. §365 to Korean Patent Application No. 10-2015-0080105, filed in Korea on Jun. 5, 2015, whose entire disclosures are hereby incorporated by reference.

BACKGROUND

1. Field

A refrigerator is disclosed herein.

2. Background

Generally, a refrigerator may have a plurality of storage compartments to keep stored food frozen or refrigerated, and one surface of each of the storage compartments may be formed to be opened and thus to put in or take out the food. The plurality of storage compartments may include a freezer compartment for keeping food frozen and a refrigerator compartment for keeping food refrigerated.

A refrigeration system in which a refrigerant is circulated may be driven in the refrigerator. The refrigeration system may include a compressor, a condenser, an expander, and an evaporator. For example, the evaporator may include a first evaporator which may be provided at one side of the refrigerator compartment and a second evaporator which may be provided at one side of the freezer compartment.

Cooling air stored in the refrigerator compartment may be cooled while passing through the first evaporator, and the cooled air may be supplied again into the refrigerator compartment. In addition, the cooling air stored in the freezer compartment may be cooled while passing through the second evaporator, and the cooled air may be supplied again into the freezer compartment.

A drawer which forms a storage space for storing the food may be provided at or in the refrigerator. The drawer may be provided to be withdrawn from a main body of the refrigerator. A device which divides the storage space of the drawer may be provided at the drawer. A refrigerator drawer is described in Korean Patent Application Number KR 10-2011-0109348 (Oct. 25, 2011), whose disclosure is hereby incorporated by reference in its entirety.

In the above-mentioned related art, a partition which divides a storage space of the drawer is provided, and a partitioning size of the storage space may be changed according to a size of the food item. The related art has described only the spirit in which sizes of a plurality of spaces having the same temperature condition are changed, and there is limitation in independently controlling the temperature of each of the divided storage spaces. In addition, in the above-mentioned related art, since a device or a flow path which supplies cooling air to an inside of the drawer is not formed, cooling air may not be properly supplied to an inner space of the drawer.

BRIEF DESCRIPTION OF THE DRAWINGS

Embodiments will be described in detail with reference to the following drawings in which like reference numerals refer to like elements, and wherein.

DETAILED DESCRIPTION

Figure 1:
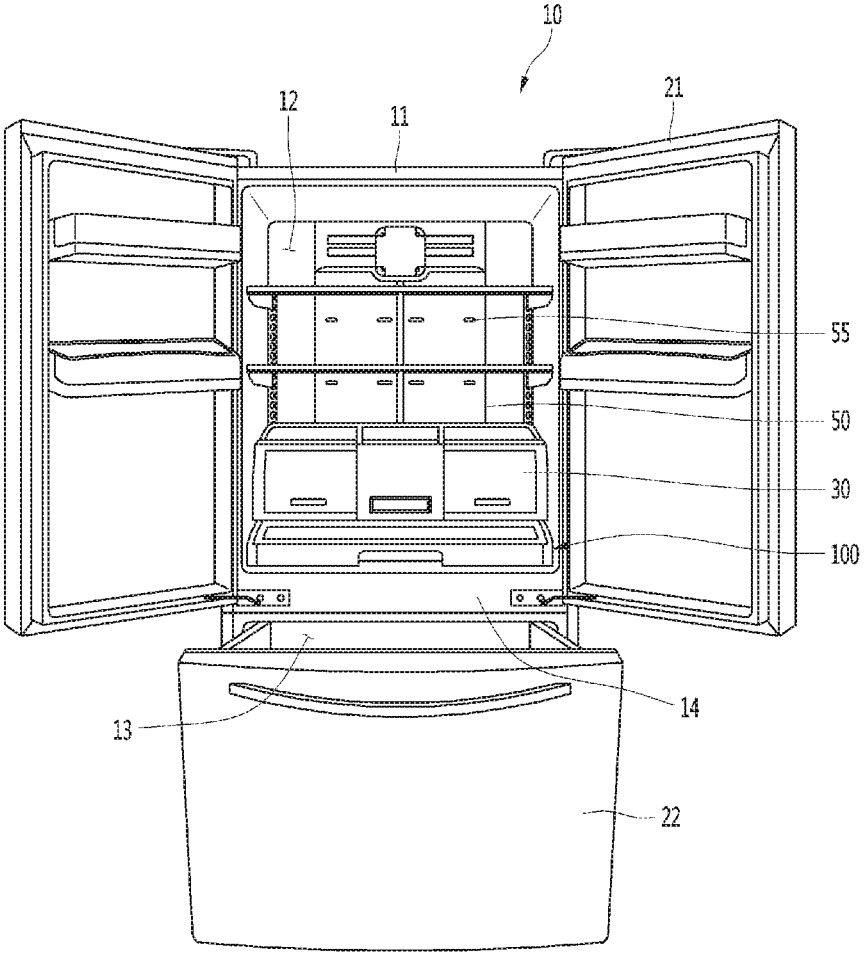
FIG. 1 illustrates a configuration of a refrigerator according to an embodiment.
Figure 2:
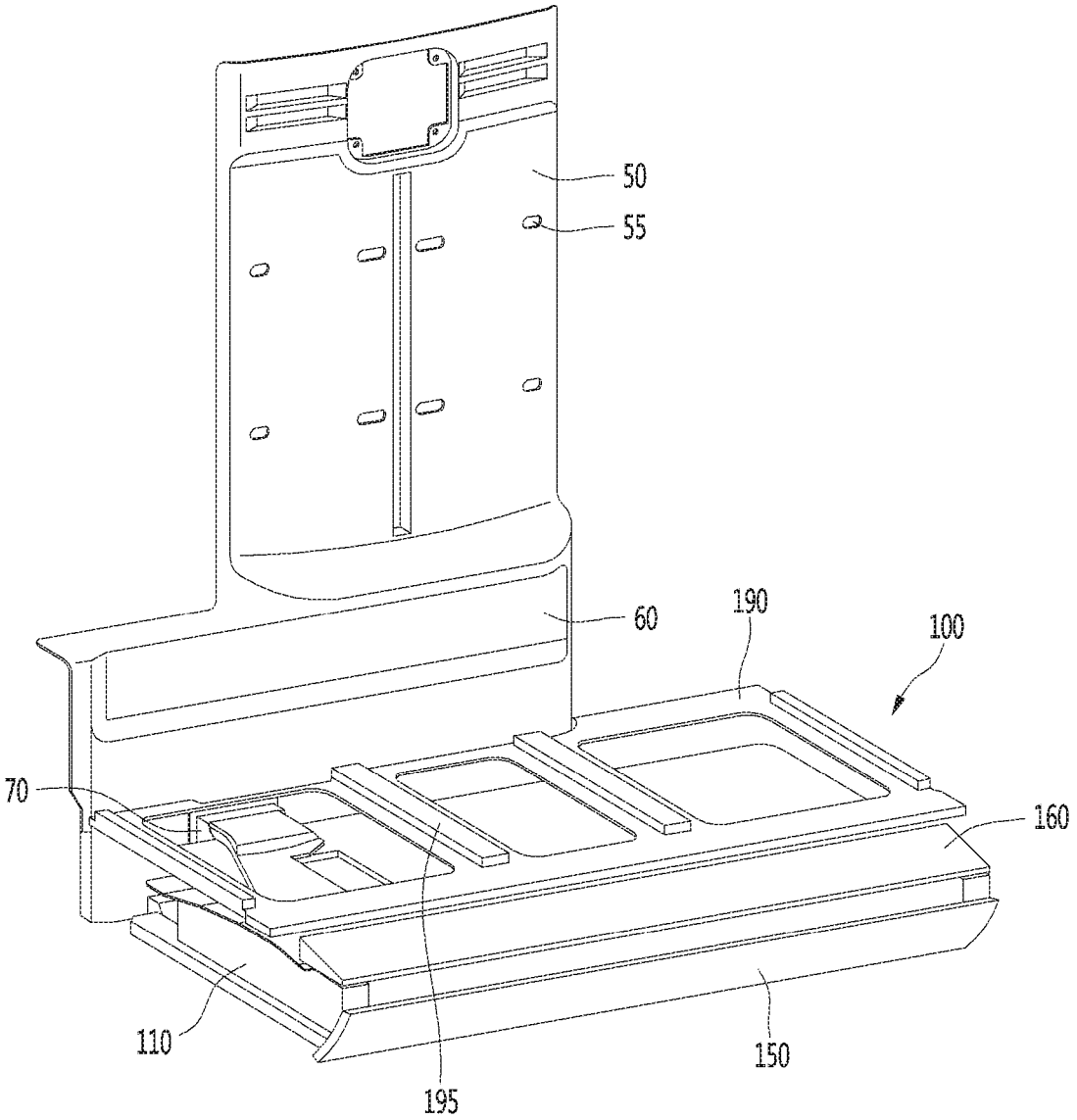
FIG. 2 illustrates a partial configuration of the refrigerator according to the embodiment.

Referring to FIGS. 1 to 4, a refrigerator 10 may include a cabinet 11 forming storage spaces 12 and 13 and doors 21 and 22 which may shield an open front surface of the cabinet 11. The storage spaces 12 and 13 may include a refrigerator compartment 12 which may keep food refrigerated and a freezer compartment 13 which may keep food frozen. The refrigerator compartment 12 may be formed at an upper side of the freezer compartment 13. In addition, the refrigerator 10 may further include a partition part 14 which may divide the refrigerator compartment 12 and the freezer compartment 13. The partition part 14 may be interposed between the refrigerator compartment 12 and the freezer compartment 13.

The doors 21 and 22 may include a refrigerator door 21 which may open and close the refrigerator compartment 12 and a freezer door 22 which may open and close the freezer compartment 13. The refrigerator door 21 may be rotatably coupled to a front of the cabinet 11, and two refrigerator doors 21 may be provided at both sides of the cabinet 11.

The freezer door 22 may be provided to be withdrawn forward. A basket which stores the food may be coupled to a rear side of the freezer door 22. The basket may be withdrawn forward together with the freezer door 22 or may be inserted into the freezer compartment 13.

The refrigerator 10 may further include a multi-duct 50 forming a rear wall of the refrigerator compartment 12 and having a cooling air outlet hole 55 for discharging cooling air generated at an evaporator to the refrigerator compartment 12. The multi-duct 50 may be a cooling air supply path for the refrigerator compartment, and a plurality of cooling air outlet holes 55 may be formed. Cooling air discharged to the refrigerator compartment 12 through the plurality of cooling air outlet holes 55 may cool the refrigerator compartment 12 while circulating the refrigerator compartment 12.

The refrigerator 10 may further include a vegetable box 30 which may store vegetables. The vegetable box 30 may be provided to be withdrawn forward, and a plurality of vegetable boxes 30 may be provided and horizontally arranged. For example, as illustrated in FIG. 1, three vegetable boxes 30 may be installed. A drawer 100 having a plurality of storage spaces having different temperatures from each other may be installed under the vegetable boxes 30. The drawer 100 may be provided to be withdrawn forward.

The drawer 100 may be installed between the vegetable boxes 30 and the partition part 14, a lower surface of the drawer 100 may be located on a top surface of the partition part 14, and a guide device which guides movement of the vegetable boxes 30 may be installed on a top surface of the drawer 100. Based on FIG. 1, a direction that the freezer door 22 or the drawer 100 is withdrawn is defined as the front, and an opposite direction is defined as the rear. In addition, a direction in which the two refrigerator doors 21 are arranged in parallel is defined as the lateral direction.

The refrigerator 10 may include a rear panel 60 which may extend to a lower side of the multi-duct 50 and form a part of the rear wall of the refrigerator compartment 12. The rear panel 60 may be integrally formed with the multi-duct 50 or may be formed as a separate panel member, and then may be coupled to the multi-duct 50. The evaporator as a heat exchanger for generating the cooling air may be installed at a rear side of the multi-duct 50 and the rear panel 60. At least a portion of the cooling air which passes through the evaporator may be introduced to the refrigerator compartment 12 through the cooling air outlet hole 55, and another portion of the cooling air may be introduced into the storage space of the drawer 100.

Figure 5:
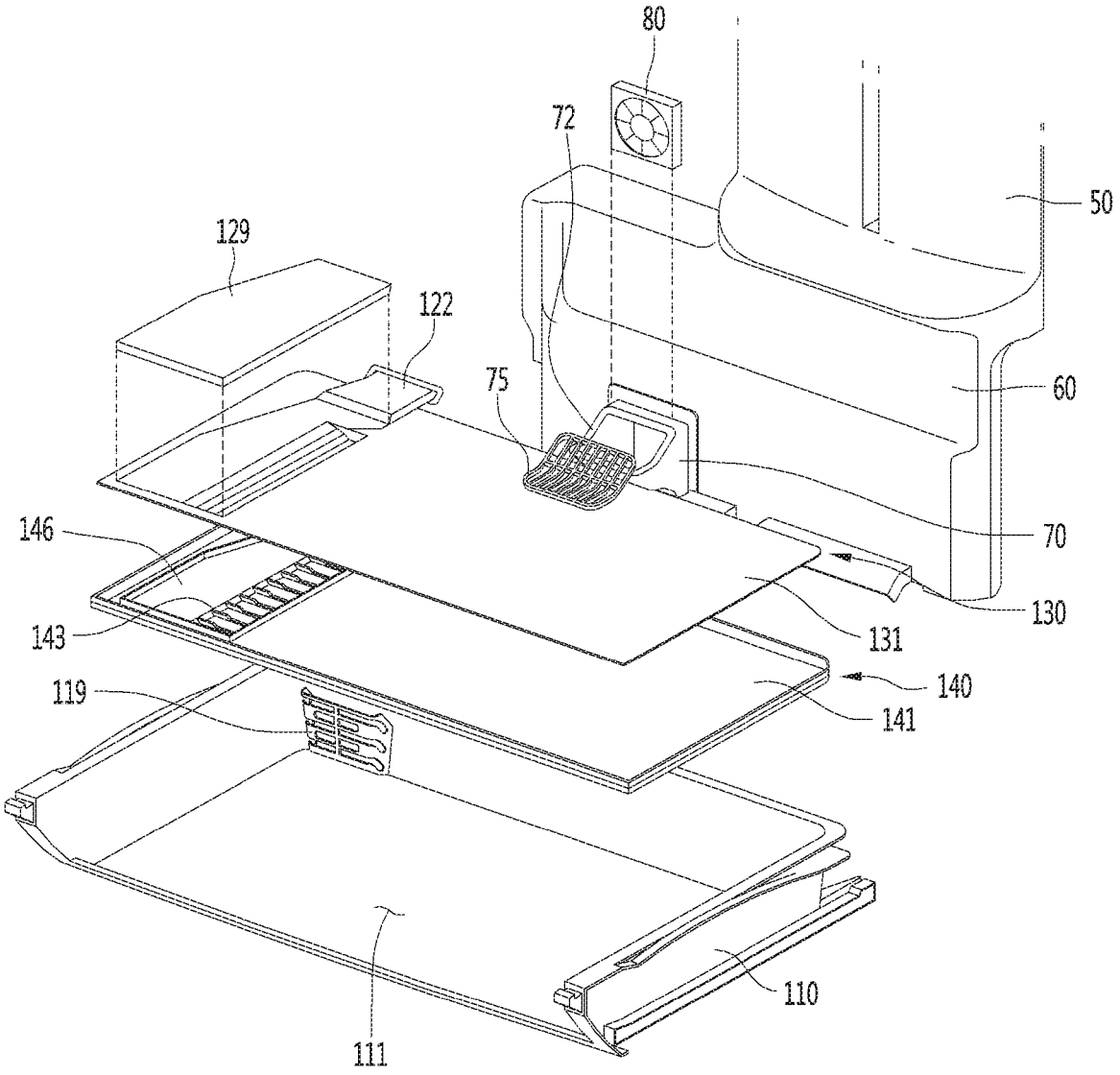
FIG. 5 is an exploded perspective view illustrating a configuration of the drawer according to the embodiment.
Figure 6:
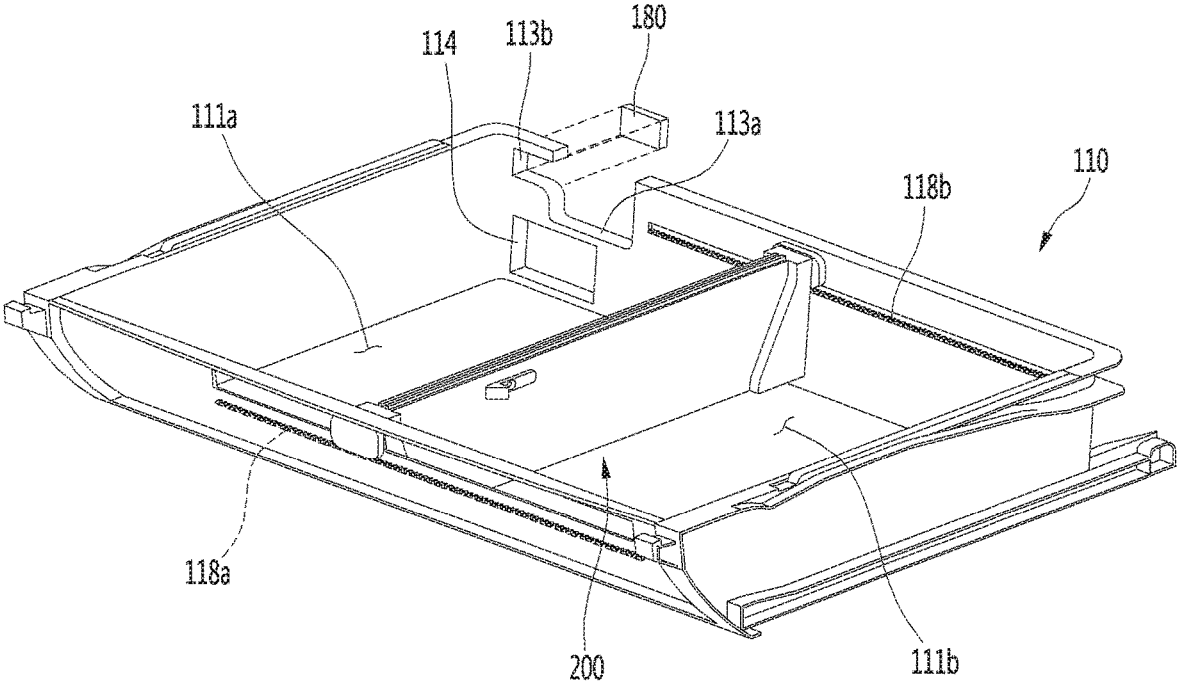
FIG. 6 illustrates a configuration of a drawer body according to the embodiment.

A fan housing 70 which may accommodate a fan 80 (referring to FIG. 5) may be provided at one side of the rear panel 60. For example, the fan housing 70 may be coupled to the front of the rear panel 60. An outlet port 72 may be formed at the fan housing 70 through which cooling air which passed through the fan 80 may be discharged. The outlet port 72 may communicate with the drawer 100, and cooling air discharged through the outlet port 100 may be supplied to a storage space 111 of the drawer 100.

The drawer 100 may be coupled to the front of the fan housing 70. The drawer 100 may include a drawer body 110 which may form the storage space 111 and may be provided to be capable of being withdrawn and inserted. The drawer 100 may further include a cooling air duct 120 which may shield at least a part of an open upper portion of the drawer body 110 and form a path through which the cooling air which passed through the fan 80 flows, and a duct supporting part (or duct support) 190 which may be provided above the cooling air duct 120 and support the cooling air duct 120. Upper and front portions of the drawer body 110 may be open. In addition, the duct supporting part 190 may be fixed to one position.

The cooling air duct 120 may be a cover member or cover which may shield the drawer body 110 and may be provided to move upward or downward. For example, in a state in which the drawer body 110 is inserted, the cooling air duct 120 may move downward due to its own weight and may be pressed against a top surface of the drawer body 110, and in a process in which the drawer body 110 is being withdrawn, the cooling air duct 120 may open the drawer body 110 while moving upward.

Figure 3:
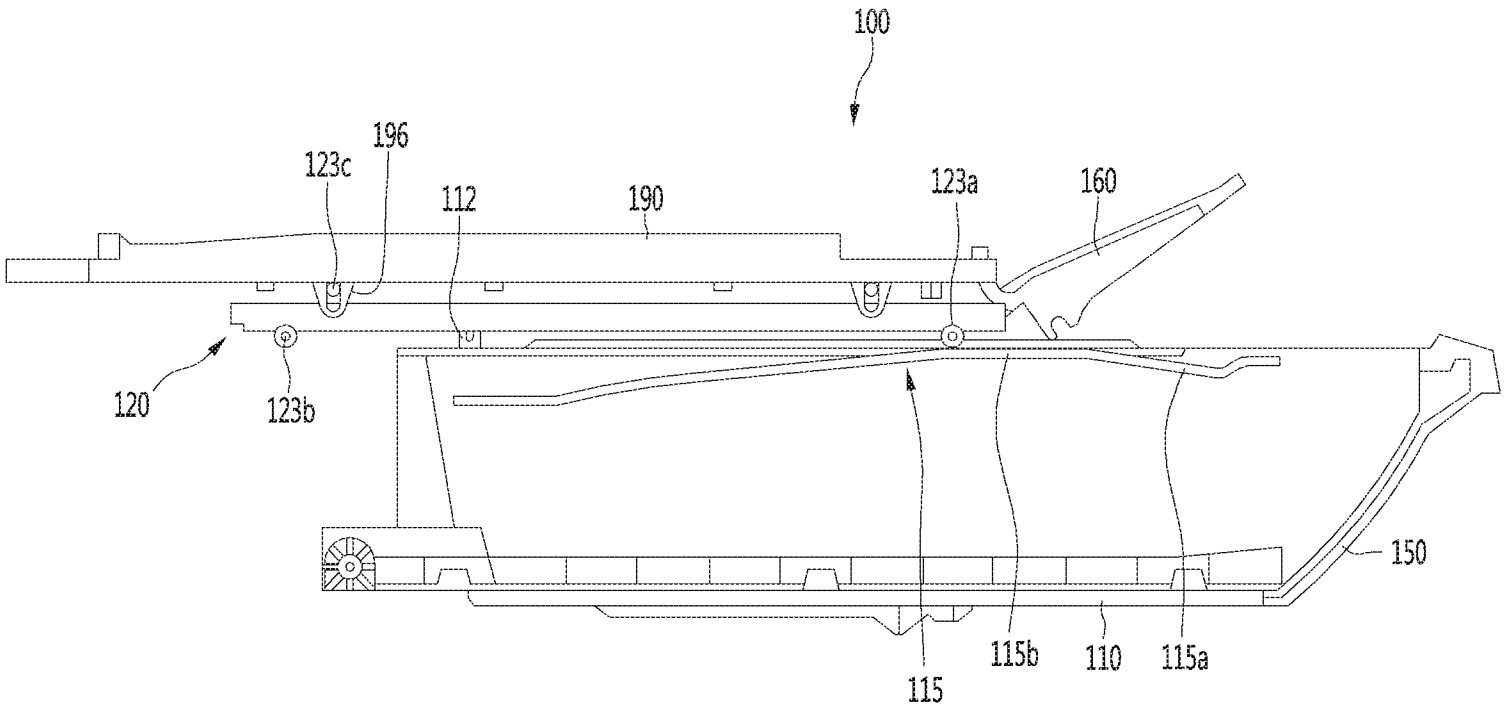
FIG. 3 illustrates an open state of a drawer according to the embodiment.

Referring to FIG. 3, a duct guide 115 which guides movement of the cooling air duct 120 may be provided at a side surface of the drawer body 110. The duct guide 115 may include a plurality of guides having different heights from one another. The plurality of guides may include a first guide 115*a* extending forward and inclined downward and second guide 115*b* extending rearward from the first guide 115*a* and provided at a position relatively higher than that of the first guide 115*a*. The first guide 115*a* may extend forward from the second guide 115*b* to be inclined downward.

A guide supporting part (or guide support) 123*a* supported by the duct guide 115 may be provided at a lower portion of the front of the cooling air duct 120. In a state in which the drawer body 110 is inserted, the guide supporting part 123*a* may be supported by an approximately center portion of the first guide 115*a*, therefore the cooling air duct 120 may move downward. The guide supporting part 123*a* may be supported by the second guide 115*b* while the drawer body 110 is being withdrawn, therefore the cooling air duct 120 may move upward.

A first protrusion 123*b* coupled to a protrusion coupling part (or protrusion coupler) 112 of the drawer body 110 may be provided at a lower portion of a rear of the cooling air duct 120. When the drawer body 110 is inserted, the first protrusion 123*b* may be coupled to the protrusion coupling part 112. While the drawer body 110 is being withdrawn, the first protrusion 123*b* may become separated from the protrusion coupling part 112, and the protrusion coupling part 112 may support a bottom surface the cooling air duct 120. The protrusion coupling part 112 may be provided at an upper portion of the rear of the drawer body 110.

Second protrusions 123*c* may be provided at front and rear upper portions of the cooling air duct 120. A supporting guide part (or supporting guide) 196 may be provided at a lower portion of the duct supporting part 190, wherein the supporting guide part 196 may guide movement of the second protrusion 123*c* while the cooling air duct 120 is moving upward or downward. Insertion ports into which the second protrusions 123*c* are inserted may be formed at the supporting guide part 196. The second protrusion 123*c* may be movably provided at an inner side of the supporting guide part 196.

In a state in which the drawer body 110 is inserted, the second protrusions 123*c* may be positioned at a lower portion of the insertion port of the supporting guide part 196. While the drawer body 110 is being withdrawn, the second protrusions 123*c* are positioned at an upper portion of the insertion port of the supporting guide part 196.

The duct supporting part 190 may include a guide device which guides withdrawing of the vegetable box 30. The guide device may include a guide rail 195 which extends forward and backward on an upper surface of the duct supporting part 190. The number of guide rails 195 may correspond to the number of vegetable boxes 30, and each of the vegetable boxes 30 may be withdrawn forward along a corresponding guide rail 195.

The drawer 100 may further include a top surface cover 160 which shields a front upper portion of the open upper portion of the drawer body 110 and a front cover 150 which shields an open front portion of the drawer body 110. While the drawer body 110 is being withdrawn, a front portion of the top surface cover 160 may rotate about a hinge part at the rear thereof. An air layer may be formed at the cooling air duct 120, the top surface cover 160, and the front cover 150. A thermal insulation performance may be improved by the air layer.

Referring to FIGS. 5 to 9, 12, and 13, a housing body 71 may be formed at the fan housing 70, wherein the housing body 71 protrudes forward from the rear panel 60 and a flow path which guides a flow of cooling air may be formed. The outlet port 72 may be formed at an upper portion of the housing body 71, wherein the outlet port 72 discharges the cooling air which passes through the fan 80. In addition, the fan 80 may be installed at an inner space of the fan housing body 71.

A housing cover 75 may be installed at the outlet port 72. A refrigerant discharged through the outlet port 72 may pass through the housing cover 75 and flow to the cooling air duct 120. The housing cover 75 may be formed in a mesh shape so that the cooling air flows smoothly. Due to the configuration of the housing cover 75, putting a user's hand into the outlet port 72 may be prevented.

The cooling air duct 120 may be a cover member which shields the upper portion of the drawer body 110. The cooling air duct 120 may include a first cover 130 and a second cover 140 coupled to a lower side of the first cover 130. A cooling air path 120*a* through which cooling air discharged from the outlet port 72 flows and the air layer 120*b* into which air is injected for thermal insulation may be included in a space between the first cover 130 and the second cover 140.

The cooling air path 120*a* and the air layer 120*b* may be divided by coupling parts (or couplers) 132 and 149 which may be coupled to each other. The coupling parts 132 and 149 may include a first coupling part (or female coupler) 132 provided at a bottom surface of the first cover 130 and a second coupling part (or male coupler) 149 provided at a top surface of the second cover 140. The first and second coupling parts 132 and 149 may be collectively referred to as a 'flow path partition part or assembly'. When the first and second covers 130 and 140 are assembled, one side surface of the first coupling part 132 may be supported by one side surface of the second coupling part 149 to separate the cooling air path 120*a* from the air layer 120*b*.

The first cover 130 may include a first cover body 131 having an approximately square panel shape and a cover 122 which covers the outlet port 72 of the fan housing 70. The cover 122 may be provided at a position corresponding to a position of the outlet port 72, for example, one side of the rear portion of the first cover body 131, and may correspond to a shape of the outlet port 72. In addition, the cover 122 may guide cool air discharged from the outlet port 72 to the cooling air path 120*a* between the first and second covers 130 and 140.

The first coupling part 132 may protrude downward from a bottom surface of the first cover body 131, and the second coupling part 149 may be inserted into a space between a part of the first cover body 131 and the first coupling part 132. The second cover 140 may include a second cover body 141 having a square panel shape corresponding to the first cover body 131, a guide surface 146 provided at an upper portion of the second cover body 141 that guides a flow of cooling air discharged from the outlet port 72, and a plurality of ribs 143 provided at one side of the guide surface 146.

The guide surface 146 may be a top surface of the second cover body 141 and have a flat surface, and the plurality of ribs 143 may be provided to protrude upward from the top surface the second cover body 141. The plurality of ribs 143 may be provided just in front of the outlet port 72, and the guide surface 146 may be provided at a side of the plurality of ribs 143. The plurality of ribs 143 may serve as a 'blocking part' which relatively blocks a flow of cooling air discharged from the outlet port 72. Therefore, the cooling air may bypass the plurality of ribs 143 and may flow toward the guide surface 146.

When the cooling air discharged from the outlet port 72 directly flows forward and then is immediately introduced into the drawer body 110, the cooling air may not be circulated in the entire region of the storage space 111 of the drawer body 110 and may be discharged through an inlet port 114 of the drawer body 110. Therefore, by providing the plurality of ribs 143, the cooling air may not flow directly forward, and may be introduced via a predetermined arc path into the drawer body 110.

The second cover 140 may be provided with a thermal insulation member 129 that prevents condensation occurring due to the cooling air path 120*a*. The thermal insulation member 129 may be provided above the second cover body 141 and may be arranged at a position above the cooling air path 120*a* to correspond to the cooling air path 120*a*. By providing the thermal insulation member 129, an occurrence of dewdrop and freezing due to a temperature difference between an inside and an outside of the cooling air path 120*a* may be prevented.

The inlet port 114 may be formed at a rear surface of the drawer body 110. A suction guide 119 which guides a flow of cooling air flowing to the inlet port 114 may be installed in front of the inlet port 114. The cooling air of a first space part (or first space) 111*a* may be suctioned into the inlet port 114 through the suction guide 119 and flow to the evaporator.

The storage space 111 may include the first space part 111*a* formed at one side of the divider 200 and a second space part (or second space) 111*b* formed at the other side. The first space part 111*a* may be one space divided from the storage space 111 of the drawer body 110 by a divider 200. The second space part 111*b* may be defined by the drawer body 110 and the divider 200 and is a space capable of being closed from the outside. Conversely, the first space part 111*a* may be defined by the drawer body 110 and the divider 200 and is a space capable of communicating with the outside through the inlet port 114. A seating part (or seat) 113*a* in which the inlet port 114 and the fan housing 70 are installed may be formed at the rear surface of the drawer body 110 which defines the second space part 111*b*.

The second cover 140 may include a communication part (or communication port) 148 which guides the cooling air flowing through the cooling air path 120*a* to flow inside the drawer body 110. The communication part 148 may be 'an introducing port' which is formed by cutting at least a part of the second cover 140 and may introduce the cooling air to the storage space 111 of the drawer body 110. The communication part 148 may be formed between the guide surface 146 forming the cooling air path 120*a* and one surface of the second cover 140 forming the air layer 120*b*.

The second cover 140 may further include a stepped portion (or step) 147 which is formed to be stepped from the guide surface 146 toward the communication part 148. Specifically, the stepped portion 147 may extend downward from the guide surface 146 and to laterally extend toward the communication part 148. In addition, the communication part 148 may be formed at an end portion of one side of the stepped portion 147 and may be positioned adjacent to one side of the coupling parts 132 and 149.

Cool air flowing along the guide surface 146 may switch a flow direction and flow downward while passing through the stepped portion 147 and may be introduced into the storage space 111 of the drawer body 110 through the communication part 148. According to such a configuration, the flow direction of the cooling air discharged from the outlet port 72 may be switched while the cooling air passes through the guide surface 146, the stepped portion 147 and the communication part 148, and thus the cooling air may be introduced into the storage space 111 of the drawer body 110. The flow from a lateral side of the drawer body 110 toward a center of the drawer body 110 may be formed, and thus the cooling air may be effectively circulated in the entire region of the storage space 111.

Seating parts (or seats) 113*a* and 113*b* which are recessed in a predetermined direction may be formed at the rear surface of the drawer body 110. Specifically, the seating parts 113*a* and 113*b* may include a first seating part (or a first seat) 113*a* which supports at least a part of the fan housing 70 and a second seating part (or a second seat) 113*b* on which a temperature sensor 180 is seated. For example, the first seating part 113*a* may be formed to be recessed downward from an upper portion of the rear surface of the drawer body 110, and the second seating part 113*b* may be formed to be further recessed laterally from the first seating part 113*a*.

In addition, an inlet port 114 through which cooling air of the storage space 111 is discharged may be formed at the rear surface of the drawer body 110. The inlet port 114 may be formed under the seating parts 113*a* and 113*b*. The seating parts 113*a* and 113*b* may be formed at an upper portion of the rear surface of the drawer body 110, and the inlet port 114 may be formed at a lower portion of the rear surface of the drawer body 110.

As the seating parts 113*a* and 113 may be formed at the rear surface of the drawer body 110, the cooling air may smoothly circulate in the first space part 111*a*. Specifically, the drawer body 110 may include a bottom surface, first and second side surfaces, and a rear surface. Cooling air may be introduced into the cooling air duct 120 through the rear surface and introduced into the first space part 111*a* through the communication part 148.

During the above described process, the cooling air may flow into the first space part 111*a* with a wide span while flowing toward the divider 200, and the cooling air which circulated in the first space part 111*a* may be discharged from the drawer body 110 through the inlet port 114 while flowing toward the rear surface of the drawer body 110 again. The divider 200 which divides the storage space 111 may be installed at the drawer body 110. For example, the divider 200 may divide the storage space 111 into a left and a right.

The storage space 111 may include the first space part 111*a* formed at a first side of the divider 200 and a second space part 111*b* formed at a second side of the divider 200. The first space part 111*a* and the second space part 111*b* may be independent spaces whose temperatures are controlled independently.

The first space part 111*a* may be a space to which the cooling air flowed through the cooling air path 120*a* is supplied, that is, a space in communication with the outlet port 72, and the second space part 111*b* may be a space to which separate cooling air is not supplied and which is indirectly cooled by a temperature of the first space part 111*a* or a temperature of the refrigerator compartment 12 nearby. For example, the first space part 111*a* may have a temperature of about −2° C., and may store a meat or fish. In addition, the second space part 111*b* may have a temperature of about 0 to 2° C. and may store vegetables or other refrigerated food.

The divider 200 may have a plate shape having top and bottom surfaces and front and rear surfaces. The lower surface of the divider 200 may be in contact with a bottom surface of the drawer body 110, and the top surface of the divider 200 may be in contact with the cooling air duct 120 and the top surface cover 160. The front surface of the divider 200 may be arranged to be in contact with the front surface cover 150, and the rear surface of the divider 200 may be in contact with the rear surface of the drawer body 110. The divider 200 may be movably provided inside the drawer body 110.

The drawer 100 may include a guide device which guides the movement of the divider 200. The guide device may include a first rack 118*a* provided at the front surface cover 150 and a second rack 118*b* provided at the rear surface of the drawer body 110. The first and second racks 118*a* and 118*b* may extend left and right, and the divider 200 may be moved along the first and second racks 118*a* and 118*b*.

Figure 7:
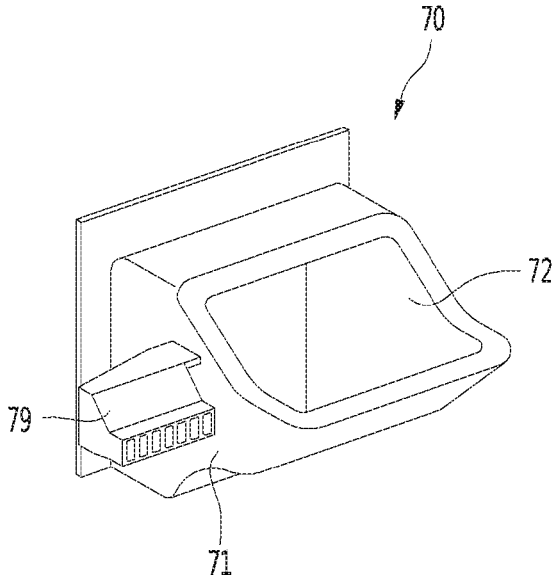
FIGS. 7 and 8 illustrate a configuration of a fan housing according to the embodiment.
Figure 8:
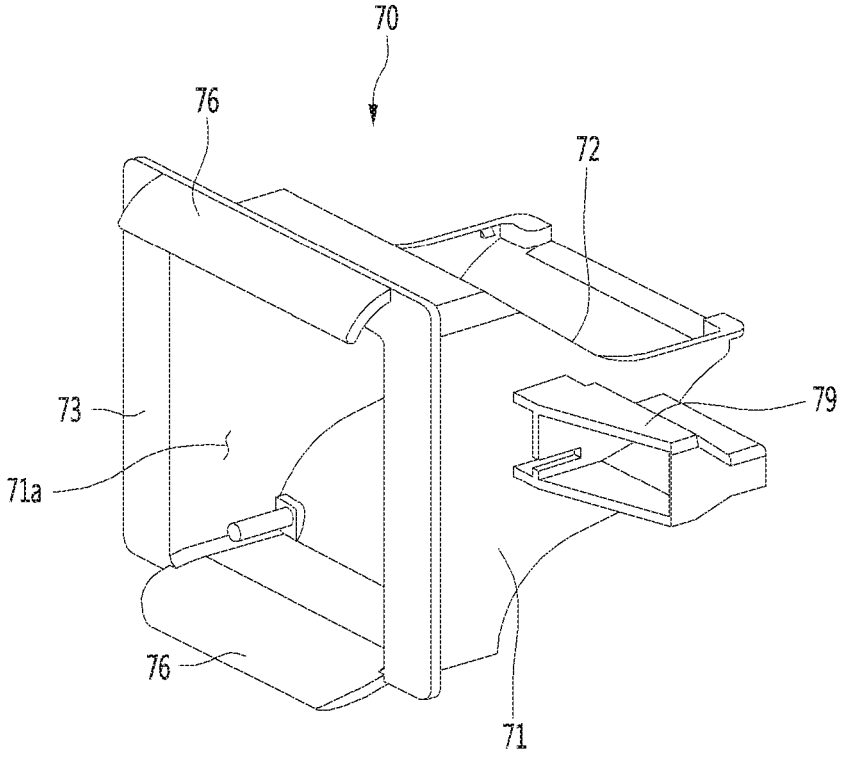
Figure 9:
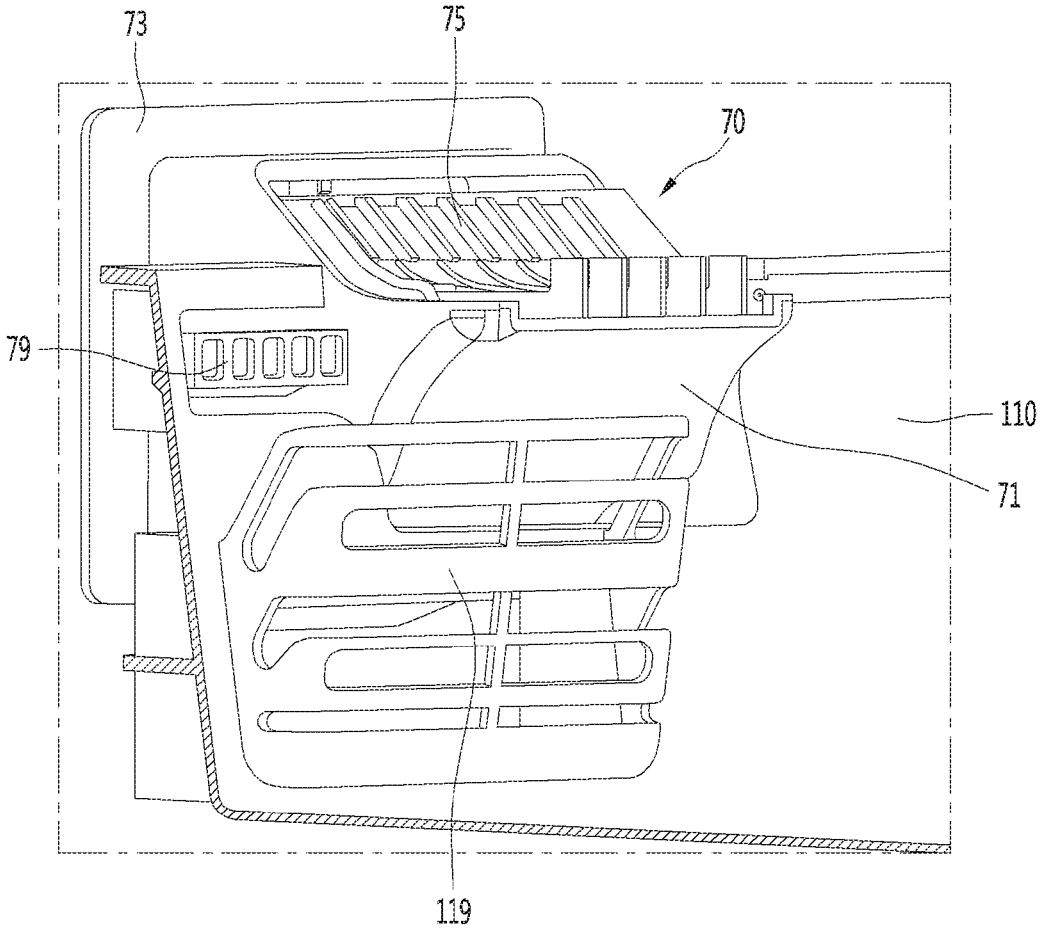
FIG. 9 illustrates a state of the fan housing and a suction guide being coupled to a rear surface of the drawer body according to the embodiment.

Referring to FIGS. 7 and 8, the fan housing 70 may include a housing body 71 which accommodates the fan 80 and forms a cooling air path and the outlet port 72 which is formed at an upper portion of the housing body 71 and introduces cooling air which passed through the fan 80 into the cooling air duct 120. The outlet port 72 may further include the housing cover 75 which guides the cooling air to the cooling air duct 120 and which may be a mesh.

A fan installation space portion (or fan installation space) 71*a* in which the fan 80 is installed may be formed at a rear portion of the housing body 71. A side surface portion of the housing body 71 may be provided with a sensor installation portion 79 in which the temperature sensor 180 may be installed. An inner space which may accommodate the temperature sensor 180 and a through hole which may be formed in a front surface of the sensor installation portion 79 and guide cool air to be introduced into the sensor installation portion 79 may be formed in the sensor installation portion 79. A temperature of the first space part 111*a* may be sensed by the temperature sensor 180. In addition, driving of the fan 80 may be controlled based on the sensed temperature.

The fan housing 70 may include a panel coupling part (or panel coupling flange) 73 extending toward an outside of the housing 70 from the rear portion of the housing body 71 and coupled to the rear panel 60, and a blocking wall 76 extending from the panel coupling part 73 to a rear of the rear panel 60. The blocking wall 76 may include an inclined surface which extends to be inclined downward in a rearward direction.

A plurality of blocking walls 76 may be provided at an upper portion and a lower portion of the panel coupling part 73. In addition, the plurality of blocking walls 76 may be positioned above and under the fan installation space portion 71*a*. The blocking wall 76 may block defrosted water generated from an evaporator at a rear side of the rear panel 60 from being introduced into the fan 80 or the housing body 71.

Figure 4:
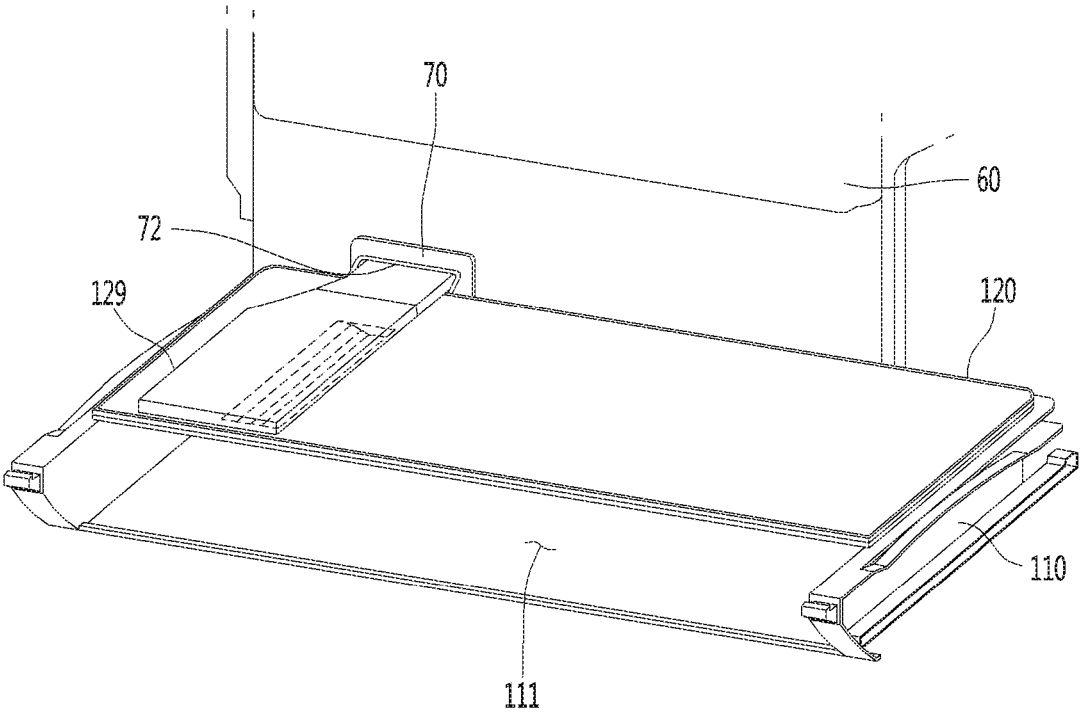
FIG. 4 illustrates a partial configuration of the drawer according to the embodiment.

Referring to FIG. 4, the cooling air duct 120 may be installed to be in communication with the outlet port 72 of the fan housing 70. The cooling air duct 120 may be coupled to the fan housing 70 to surround at least a part of the fan housing 70 so that cooling air discharged through the outlet port 72 does not leak to the outside of the cooling air duct 120.

Figure 10:
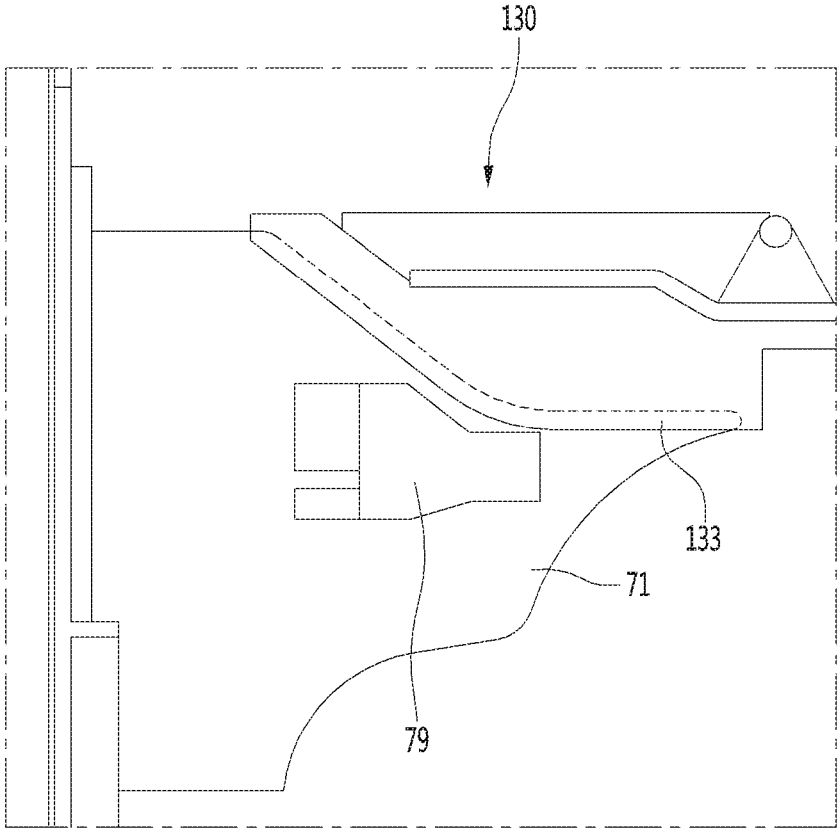
FIG. 10 is a side view illustrating a configuration of a cooling air duct coupled to the fan housing according to the embodiment.
Figure 11:
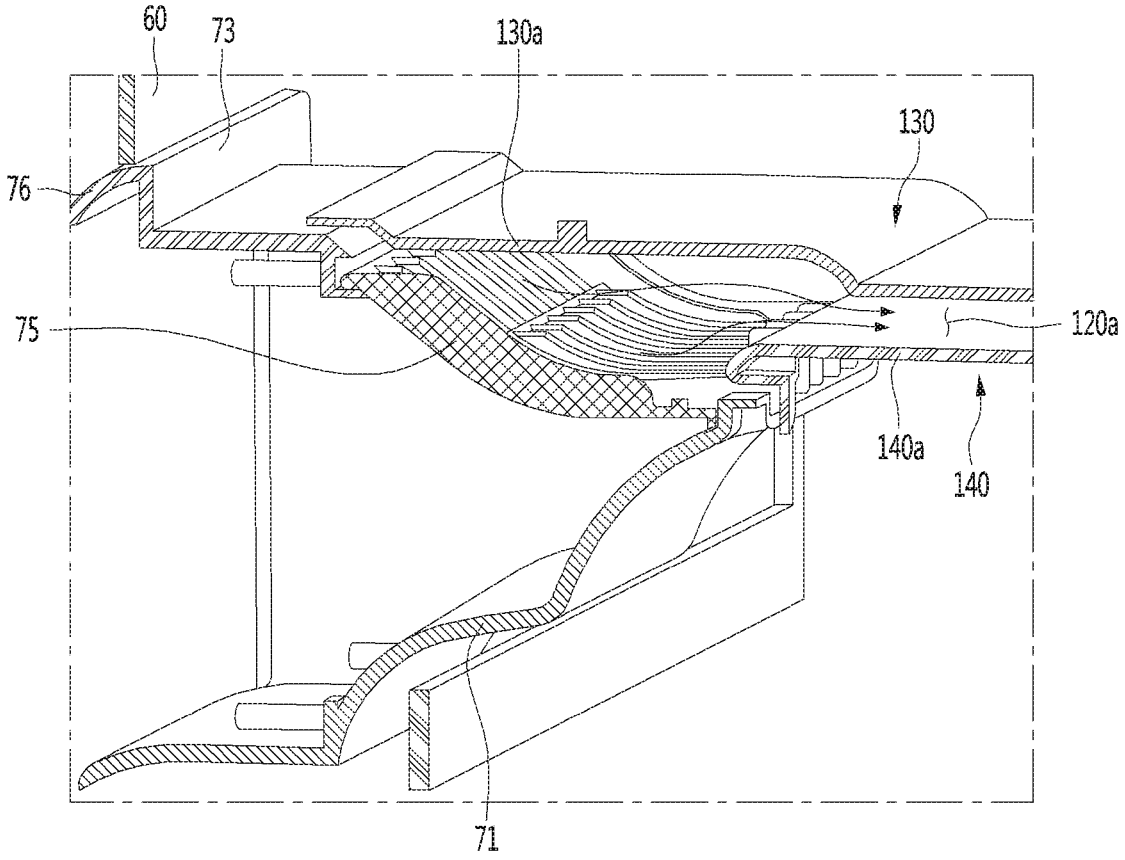
FIG. 11 is a cross-sectional view illustrating a configuration of the fan housing and the cooling air duct according to the embodiment.
Figure 12:
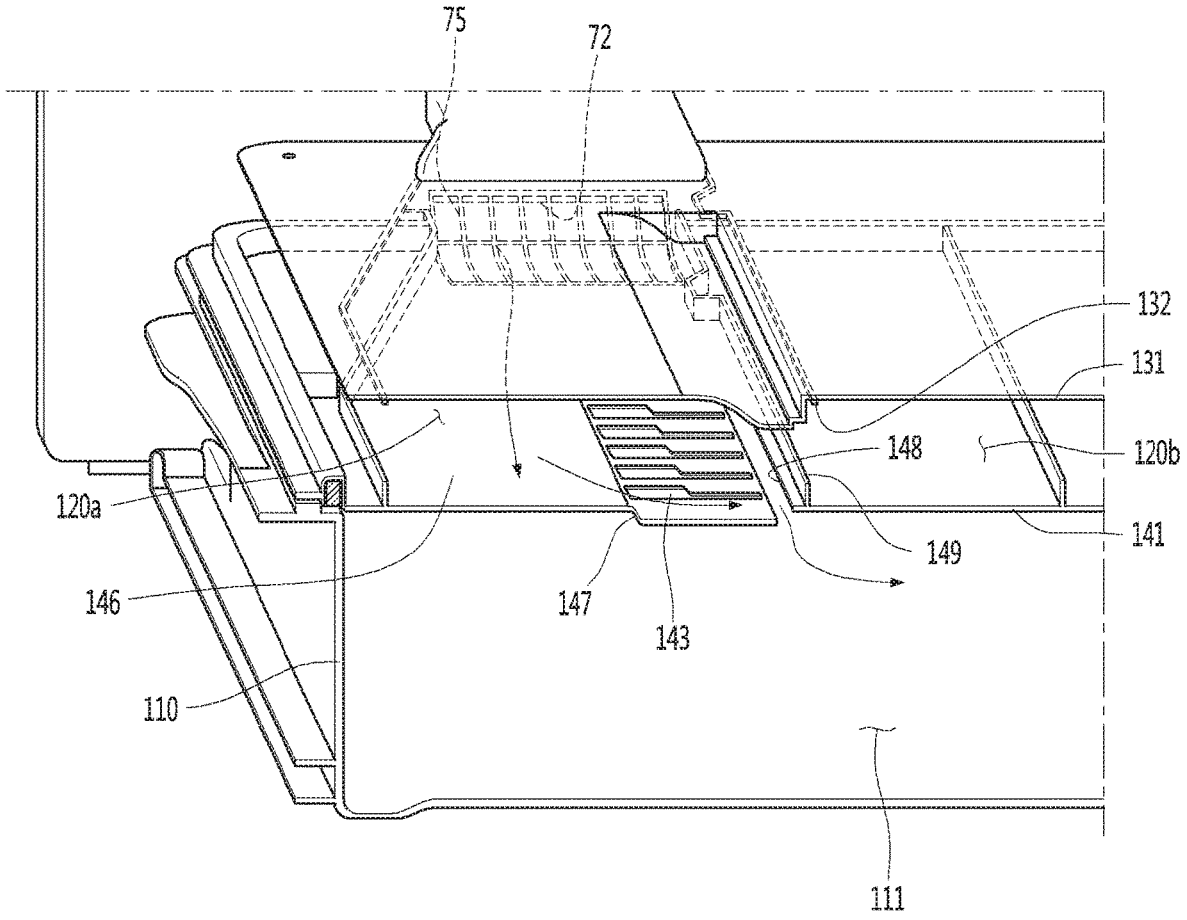
FIG. 12 is an exploded cross-sectional view illustrating a configuration of a cooling air path of the drawer according to the embodiment.
Figure 13:
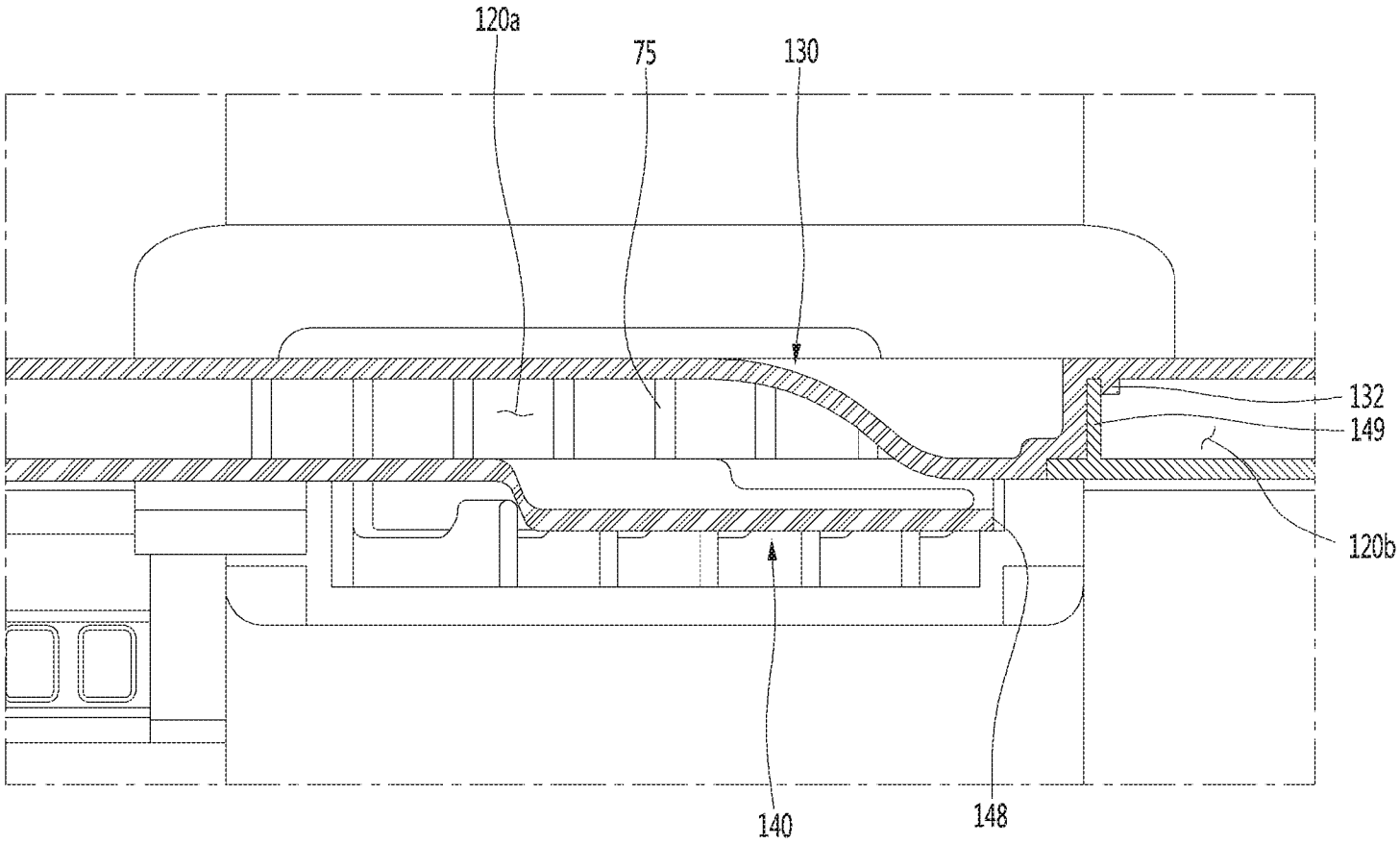
FIG. 13 is a cross-sectional view illustrating a configuration of the cooling air path of the drawer according to the embodiment.

Specifically, referring to FIG. 10, the cooling air duct 120 may include a housing coupling part 133 provided to surround an upper edge portion of the housing body 71. For example, the housing coupling part 133 may be formed at a rear portion 130*a* (referring to FIG. 11) of the first cover 130. The first cover 130 and the fan housing 70 may be provided so that an outer surface. of the upper edge portion of the housing body 71 is in contact with an inner surface of the housing coupling part 133. Cooling air discharged through the outlet port 72 may then he smoothly guided to the cooling air path 120*a* of the cooling air duct 120 without leaking.

The housing cover 75 may be coupled to the outlet port 72. The outlet port 72 may be formed at an upper portion of the fan housing 71 to supply cooling air to the cooling air path 120*a* formed at a position higher than that of the outlet port 72. The housing cover 75 may also have a mesh shape to guide cooling air supply to the cooling air path 120*a*. The cooling air path 120*a* formed between the first and second covers 130 and 140 may be provided at the front of the housing cover 75.

The first cover 130 may be coupled to an upper portion of the outlet port 72, and the second cover 140 may be coupled to a lower portion of the outlet port 72. The lower portion of the outlet port 72 may be positioned closer to a front of the refrigerator 10 than the upper portion of the outlet port 72. Therefore, a rear portion 130*a* of the first cover 130 may extend more toward a rear of the refrigerator 10 than the rear portion 140*a* of the second cover 140. According to the above-described structure, cooling air discharged through the outlet port 72 may be guided by the rear portion 130*a* of the first cover 130 and be introduced into the cooling air path 120*a*.

Figure 14:
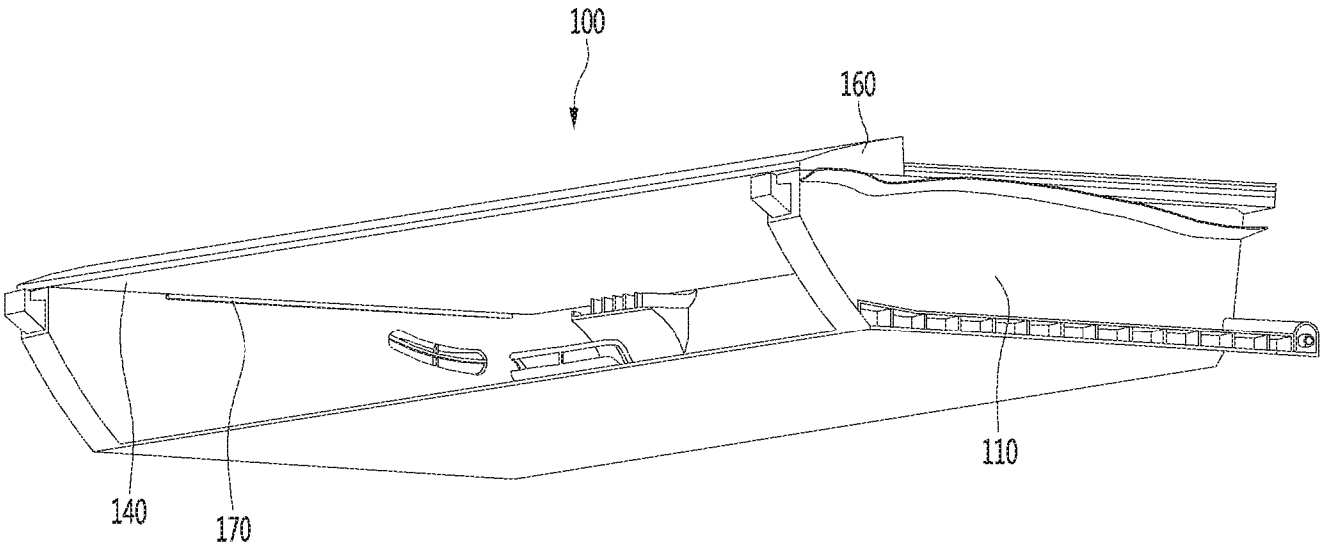
FIG. 14 illustrates a state of a first sealing member being provided at one side of a second cover according to the embodiment.
Figure 15:
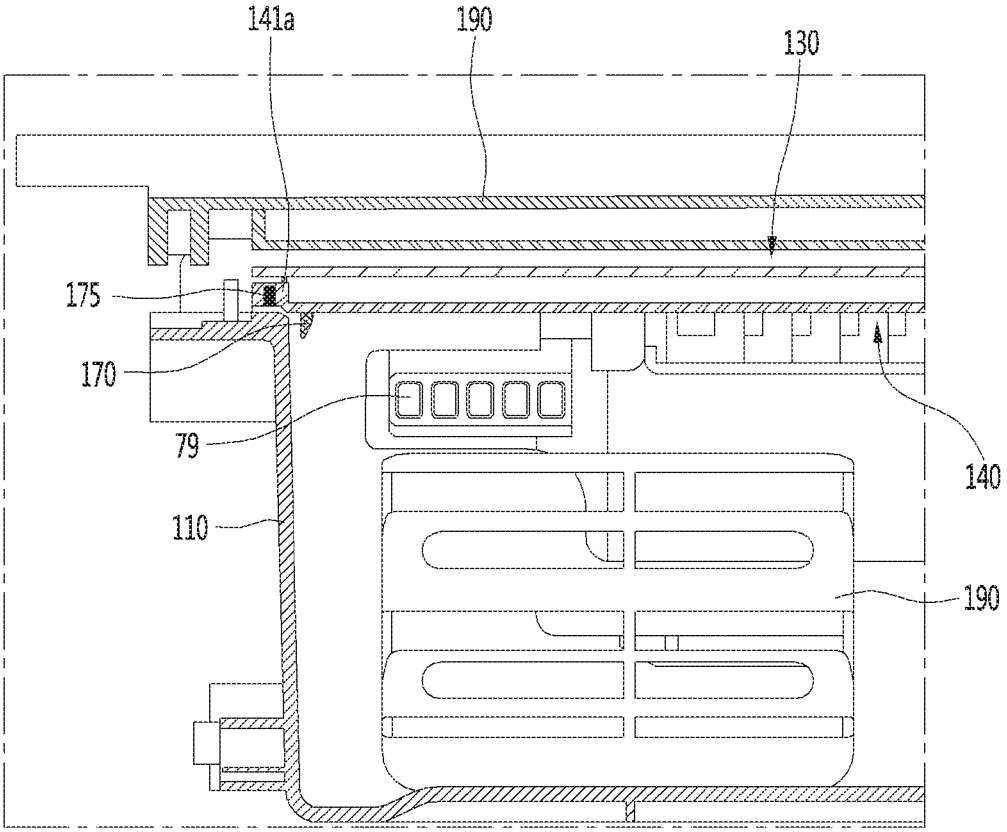
FIG. 15 is a cross-sectional view illustrating a configuration of the first and second sealing members according to the embodiment.

Referring to FIGS. 14 and 15, the drawer 100 may further include a first sealing member (or first seal) 170 which prevents cooling air inside the storage space 111 from leaking through a gap which may be generated between the drawer body 110 and the cooling air duct 120. Specifically, the first sealing member 170 may be configured to protrude downward from a lower portion of the cooling air duct 120, or from a bottom surface of the second cover 140, and may be provided at a position spaced a set distance from a side surface portion of the drawer body 110 toward the inside thereof.

A plurality of first sealing members 170 may be provided. For example, the plurality of first sealing members 170 may be provided at left and right side surface portions of the second cover 140. According to the configuration of the first sealing member 170, when a user incorrectly positions the drawer body 110 while inserting and withdrawing the drawer 100, at least a part of the gap which may be generated between the drawer body 110 and the cooling air duct 120 may be blocked.

The drawer 100 may further include a second sealing member (or second seal) 175 which is interposed between the top surface of the drawer body 110 and the second cover 140 and may prevent cooling air from leaking. The top surface of the drawer body 110 may be an upper edge portion of the drawer body 110 and may be surface which supports the cooling air duct 120 in a state in which the drawer body 110 is inserted.

A groove 141*a* in which the second sealing member 175 may be inserted may be formed in the second cover 140. The groove 141*a* may be formed along an edge portion of the second cover 140 having a square panel shape. For example, the groove 141*a* may also be formed so that at least a part of the edge portion of the second cover body 141 is recessed upward.

In a state in which the second sealing member 175 is coupled to the groove 141*a*, when the drawer body 110 is inserted, the second sealing member 175 may be pressed against the top surface of the drawer body 110. In such a configuration and an action, cooling air in the storage space 111 may be prevented from being discharged to the outside of the storage space 111.

A refrigerator may be capable of properly supplying cooling air to a storage space of a drawer. The refrigerator may include a cabinet forming a storage compartment; a rear panel forming a rear wall of the storage compartment and having a cooling air outlet hole which discharges cooling air toward the storage compartment; a fan housing coupled to the rear panel and in which a fan configured to generate a circulation of cooling air is installed; an outlet port which is formed at the fan housing and discharges cooling air supplied by driving of the fan; and a drawer provided capable of being withdrawn forward from an inside of the storage compartment, wherein, the drawer includes: a drawer body forming a storage space; and a cooling air duct provided above the drawer body and having a cooling air path in communication with the outlet port.

The cooling air duct may include: a first cover; and a second cover which is coupled to a lower side of the first cover and shields at least a part of an open upper portion of the drawer body. The cooling air path may include at least a part of a space between the first cover and the second cover. The second cover may include a guide surface which forms a top surface of the second cover and guides a flow of cooling air which was discharged from the outlet port; and a blocking part which is provided at one side of the guide surface and protrudes upward from the top surface of the second cover to interfere with the flow of cooling air.

The blocking part may be positioned just in front of the outlet port, and the guide surface may be positioned at a lateral side of the blocking part. The second cover may include an introducing port which introduces cooling air flowing through the cooling air path to be introduced into the drawer body.

The refrigerator may further include a flow path partition part which is provided between the first cover and the second cover and divides a space between the first cover and the second cover into the cooling air path and an air layer. The fan housing may include a housing body which accommodates the fan; a panel coupling part provided at a rear portion of the housing body and coupled to the rear panel; and a blocking wall extending from the panel coupling part to a rear of the rear panel to prevent defrosted water from being introduced into the housing body.

The drawer body may be defined by a bottom surface, both side surfaces, and a rear surface, and a rear surface of the drawer body may include a first seating part in which the fan housing is installed. An inlet port which guides cooling air in the storage space to be discharged to an outside of the drawer body may be provided at the rear surface of the drawer body.

The seating part may be formed at an upper portion of the rear surface of the drawer body, and the inlet port may be formed at a lower portion of the rear surface of the drawer body. The rear surface of the drawer body may include a second seating part in which a temperature sensor is installed. The second seating part may be formed laterally recessed from the first seating part.

The cooling air duct may include a housing coupling part disposed to surround an edge portion of the housing body. The first cover may be provided with a thermal insulation member disposed at one side of the cooling air path to prevent freezing of the cooling air duct.

The refrigerator may further include a first sealing member configured to protrude toward a lower portion of the cooling air duct and provided at a position spaced a set distance from a side portion of the drawer body toward an inside thereof. The refrigerator may further include a groove formed along an edge of the second cover; and a second sealing member installed at the groove of the second cover to be pressed against a top surface of the drawer body.

An inside of the drawer body may further include a divider which divides an inner space of the drawer body and is movably provided. The cooling air duct may be provided movable upward or downward, the cooling air duct may move upward when the drawer body is withdrawn, and the cooling air duct may move downward when the drawer body is inserted.

A refrigerator may include a cabinet forming a storage compartment; a fan housing installed at a rear wall of the storage compartment and having an outlet port which discharges cooling air; a fan installed in the fan housing; and a drawer installed in the storage compartment, wherein the drawer is provided with: a drawer body forming a storage space; and a cooling air duct which covers an upper side of the drawer body, and the cooling air duct includes: a plurality of covers; and a cooling air path formed between the plurality of covers and configured to transfer cooling air discharged through the outlet port to the storage space.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet forming a storage compartment;

a rear panel forming a rear wall of the storage compartment and having at least one cooling air outlet hole which discharges cooling air toward the storage compartment;

a fan housing coupled to the rear panel and in which a fan configured to generate a circulation of the cooling air is installed, the fan housing including an outlet port configured to discharge the cooling air supplied by driving of the fan;

a drawer provided in the storage compartment, wherein the drawer includes:

a drawer body forming a storage space, the drawer body including a front part, a pair of side parts and a rear part;

a divider configured to partition the storage space into a first space and a second space, the divider including a movable wall configured to block the cooling air in one of the first and second spaces from flowing to the other one of the first and second spaces;

a temperature sensor provided at the drawer body and configured to sense temperature of the cooling air in the first space; and a cooling air duct provided above the drawer body and including a first cover, a second cover, and a cooling air path formed between the first cover and the second cover, the cooling air duct being configured to directly supply the cooling air only into the first space, wherein the second space comprises a closed space defined by the movable wall of the divider, the drawer body and the cooling air duct, the closed space configured to be indirectly cooled by the cooling air provided in the first space, wherein the fan housing comprises a first housing part located in the drawer body and a second housing part having the outlet port located between the first cover and the second cover, wherein the rear part of the drawer body comprises a first portion defining a rear end of the first space and a second portion defining a rear end of the second space, and wherein a first seat in which the first housing part is seated and a second seat in which the temperature sensor is seated, are formed in the first portion of the rear part.

2. The refrigerator of claim 1, wherein the cooling air duct is arranged such that the cooling air duct is in communication with the first space and not to the second space.

3. The refrigerator of claim 2, further comprising an inlet port defined in a wall of the first space and through which the cooling air in the first space is discharged.

4. The refrigerator of claim 3, wherein the first space and the second space are arranged in a lateral direction of the refrigerator.

5. The refrigerator of claim 3, wherein the first space comprises a bottom, a front surface, a rear surface including the wall, and a side surface, and wherein the inlet port is formed at the rear surface of the first space.

6. The refrigerator of claim 1, wherein the first seat is recessed downward from a top of the rear surface of the first space, and wherein the inlet port is formed below the first seat.

7. The refrigerator of claim 1, wherein the temperature sensor is adjacent to the fan housing.

8. The refrigerator of claim 7, wherein the second seat is connected to the first seat.

9. The refrigerator of claim 1, wherein the drawer further includes at least one rack with which the movable wall of the divider is interlocked, wherein the at least one rack is provided at the front part or the rear part of the drawer body.

10. The refrigerator of claim 1, wherein the cooling air duct further comprises a coupler extending from the first cover towards the second cover to divide an inner space between the first cover and the second cover into the cooling air path and an air layer.

11. The refrigerator of claim 10, wherein the second cover comprises:

a guide surface which forms a bottom of the cooling air path and guides a flow of the cooling air which was discharged from the outlet port; and a communication port which introduces the cooling air flowing through the cooling air path to the drawer body, the communication port being located between the guide surface and the coupler.

12. The refrigerator of claim 11, wherein the second cover further comprises:

a step that is stepped from the guide surface toward the communication port; and at least one rib provided at a side of the outlet port, the at least one rib protruding upward from the step.

13. The refrigerator of claim 12, wherein the at least one rib comprises a plurality of ribs configured to interfere with the flow of the cooling air, and wherein the plurality of ribs being configured to change a flow direction of the cooling air from a first direction to a second direction, different from the first direction.

14. The refrigerator of claim 12, wherein the plurality of ribs is positioned in front of the outlet port, and the guide surface is positioned at a lateral side of the plurality of ribs.

15. The refrigerator of claim 1, wherein the fan housing includes:

a housing body which accommodates the fan and includes the first housing part and the second housing part;

a panel coupling flange provided at a rear portion of the housing body and coupled to the rear panel; and a blocking wall extending from the panel coupling flange rearward and provided behind the rear panel to prevent defrosted water from being introduced into the housing body.

16. The refrigerator of claim 1, further comprising:

a first seal protruding toward a lower portion of the cooling air duct, the first seal being arranged at a position spaced apart from a side portion of the drawer body toward an inside thereof; and a second seal installed at a groove of the second cover, the groove being formed along an edge of the second cover.

17. A refrigerator comprising:

a cabinet forming a storage compartment;

a rear panel forming a rear wall of the storage compartment and having at least one cooling air outlet hole which discharges cooling air toward the storage compartment;

a fan housing coupled to the rear panel and in which a fan configured to generate a circulation of the cooling air is installed;

an outlet port which is formed at the fan housing and discharges the cooling air supplied by driving of the fan; and a drawer provided in the storage compartment, wherein the drawer includes:

a drawer body forming a storage space;

a divider configured to partition the storage space into a first space and a second space; and a cooling air duct provided above the drawer body, the cooling air duct being configured to directly supply the cooling air only into the first space, and including a first cover, a second cover provided at a lower side of the first cover and a cooling air path formed between the first cover and the second cover, wherein the cooling air is provided to the first space from an outside of the drawer, and the second space is indirectly cooled by the cooling air provided in the first space, wherein the cooling air duct comprises a coupler extending from the first cover towards the second cover to divide an inner space between the first cover and the second cover into the cooling air path and an air layer, and wherein the air layer is formed between the first cover and the second cover such that the first space and the second space are separated from the air layer by the second cover.

18. A refrigerator comprising:

a cabinet forming a storage compartment;

a rear panel forming a rear wall of the storage compartment and having at least one cooling air outlet hole which discharges cooling air toward the storage compartment;

a fan housing coupled to the rear panel and in which a fan configured to generate a circulation of the cooling air is installed;

an outlet port which is formed at the fan housing and discharges the cooling air supplied by driving of the fan; and a drawer provided in the storage compartment, wherein the drawer includes:

a drawer body forming a storage space;

a divider configured to partition the storage space into a first space and a second space; and a cooling air duct provided at the drawer body and including a first cover, a second cover and a cooling air path formed between the first cover and the second cover, wherein the cooling air duct includes an air layer formed between the first cover and the second cover for thermal insulation of the cooling air duct, the air layer being separated from the cooling air path, wherein the cooling air path is disposed vertically above the first space such that the cooling air is provided to the first space from an outside of the drawer through the cooling air path, and wherein the air layer is disposed vertically above the second space and is separated from the first space and the second space by the second cover such that the second space is indirectly cooled by the cooling air provided in the first space without introduction of the cooling air.

* * * * *